United States Patent [19]

Chachin et al.

[11] 4,169,713

[45] Oct. 2, 1979

[54] MACHINE FOR THREE-DIMENSIONAL POLISHING OF WORKPIECES SHAPED AS SOLIDS OF REVOLUTION IN A MAGNETIC FIELD USING FERROMAGNETIC ABRASIVE POWDERS

[76] Inventors: Viktor N. Chachin, ulitsa Kulman, 15, kv. 91; Faddei J. Sakulevich, pereulok Dalny, 3; Leonty A. Olender, ulitsa Ya. Kolasa, 67, kv. 14, all of Minsk; Grigory K. Serdyaev, ulitsa Zhukovskogo, 1, kv. 16, Udmurtskaya ASSR, Sarapul; Alexandr A. Kosobutsky, ulitsa R. Ljuxemburg, 171, kv. 5, Minsk; Oleg S. Murkov, Moskovsky prospekt, 25, kv. 42, Vitebsk; Vitaly P. Sobolevsky, pereulok Uralsky, 13, kv. 65, Minsk, all of U.S.S.R.

[21] Appl. No.: 895,474

[22] Filed: Apr. 11, 1978

[30] Foreign Application Priority Data

Jul. 26, 1977 [SU] U.S.S.R. ..... 2513230

[51] Int. Cl.[2] ..... B24B 31/00

[52] U.S. Cl. ..... 51/7; 51/156

[58] Field of Search ..... 51/7, 17, 26, 163.1, 51/163.2, 150, 156

[56] References Cited

U.S. PATENT DOCUMENTS 2,899,777 8/1959 Davidson ..... 51/7

FOREIGN PATENT DOCUMENTS 403537 4/1974 U.S.S.R. ..... 51/7

*Primary Examiner*—Harold D. Whitehead

*Attorney, Agent, or Firm*—Fleit & Jacobson

[57] ABSTRACT

The machine for three-dimensional polishing of workpieces shaped as solids of revolution in a magnetic field using ferromagnetic abrasive powder comprises an electromagnetic system having an air gap for the ferromagnetic abrasive powder to retain therein, spindles for the workpieces being machined to hold, a mechanism for traversing the spindles adapted for the workpieces being machined to pass through the air gap of the electromagnetic system, and mechanisms for the spindles to rotate round their own axes and oscillate. The spindle oscillating mechanism comprises a cam held in position to the spindle and adapted to engage, with its shaped face, the eccentric roller whose shaft is square with the axis of rotation of the spindle carrying the cam.

2 Claims, 2 Drawing Figures

Figure 1:
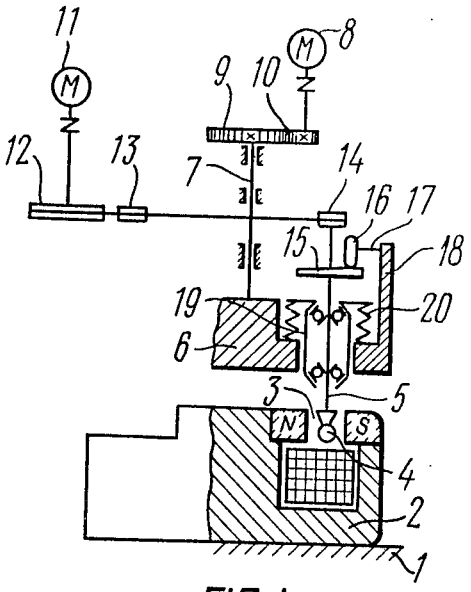

MACHINE FOR THREE-DIMENSIONAL POLISHING OF WORKPIECES SHAPED AS SOLIDS OF REVOLUTION IN A MAGNETIC FIELD USING FERROMAGNETIC ABRASIVE POWDERS

This invention relates generally to abrasive treatment of workpieces in a magnetic field and has particular reference to machines for three-dimensional polishing of workpieces shaped as solids of revolution in a magnetic field using ferromagnetic abrasive powders.

One prior-art machine for three-dimensional polishing with ferromagnetic abrasive powders is known to comprise an electromagnetic system with an air gap for the ferromagnetic abrasive powder to retain therein, spindles for the workpieces being machined to hold, said spindles being linked to a mechanism for their traversing adapted for the workpieces being machined to pass through the air gap, and mechanisms for the spindles to rotate round their own axes and oscillate concurrently.

In said machine the oscillating mechanism is in fact a crank gear actuating the spindles.

A disadvantage of such a mechanism resides in great forces of inertia that are liable to result from transmitting oscillating motion simultaneously to all the spindles from a robust crank gear producing oscillating motion which affects adversely the smooth spindle movement by virtue of oscillation, results in vibration of the machine and abnormally high noise level.

Moreover, the oscillating mechanism of the character set forth hereinbefore is not provided with a possibility to adjust the amplitude of the spindle oscillating motion, whereas the oscillating motion of the spindles features the same amplitude and frequency so as to obey the harmonic law. This eventuates in repeatability of the contact marks of the ferromagnetic abrasive powder particles on the surface of the workpieces being machined and hence in uneven surface machining.

It is by virtue of the disadvantages discussed above that the prior-art machine is capable of neither high quality of surface finish nor high machining capacity.

It is an essential object of the present invention to attain higher quality of surface finish and machining capacity.

The essence of the invention resides in that in a machine for three-dimensional polishing of workpieces shaped as solids of revolution in a magnetic field using ferromagnetic abrasive powder, comprising an electromagnetic system having an air gap for the ferromagnetic abrasive powder to retain therein, spindles for the workpieces being machined to hold, said spindles being linked to a mechanism for their traversing adapted for the workpieces being machined to pass through the air gap, and mechanisms for the spindles to rotate round their own axes and oscillate concurrently, according to the invention each of the mechanisms for imparting oscillating motion to the spindles is made as a cam locked in position on the spindle and adapted to engage, with its shaped working face, a freely rotatable eccentric roller whose shaft is square with the axis of rotation of the spindle carrying the cam.

Such an embodiment of the spindle oscillating mechanism makes it possible to obtain uniform machining of workpieces due to nonrepeatable contact marks of the particles of the ferromagnetic abrasive powder on the surfaces of the workpieces being machined. Said effect is achieved due to compound motion performed by the spindle when imparted oscillating motion with continually changing amplitude and frequency, said compound motion being ensured by the cam engaging, with its shaped working face, the freely rotatable eccentric roller.

It is expedient that the eccentric rollers be adjustably traversable lengthwise their shafts so as to change the distance from said rollers and the axis of rotation of the spindles carrying the cams.

This feature enables one to set up a required spindle oscillation amplitude, as well as to select such a length of the roller riding over the shaped cam face as to attain nonrepeatability of the contact marks of the particles of the ferromagnetic abrasive powder on the surfaces of the workpieces being machined, thereby obtaining evenly machined surfaces.

Figure 2:
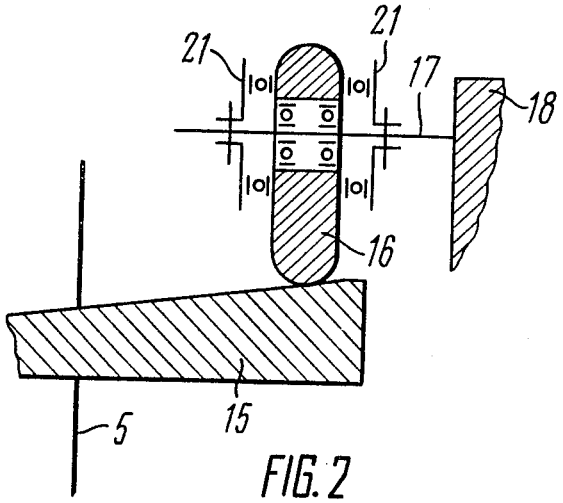

Given below is a detailed description of a specific embodiment of the present invention by way of illustration with reference to the accompanying drawings, wherein:

FIG. 1 is a schematic longitudinal section view of a machine for three-dimensional polishing of workpieces shaped as solids of revolution in a magnetic field using ferromagnetic abrasive powders, according to the invention; and FIG. 2 is a scaled-up longitudinal section view of an oscillating mechanism of the machine, according to the invention.

Referring now to the accompanying drawings FIG. 1 illustrates a base 1 carrying an electromagnetic system 2 featuring an annular air gap 3 adapted to retain the ferromagnetic abrasive powder and accommodating workpieces 4 being machined which are held in spindles 5 situated circumferentially in a rotor 6 located above the electromagnetic system 2 (only one spindle 5 being purposely illustrated in FIG. 1).

The mechanism for the spindles 5 to traverse, adapted for passing the workpieces 4 being machined through the air gap 3, comprises a central shaft 7 whose top end is linked to a motor 8 through gears 9 and 10, while its bottom end is coupled to the rotor 6.

The mechanisms for rotating the spindles 5 round their own axes comprise a drive pulley 12 mechanically coupled to a motor 11 through a belt drive, deflecting pulleys 13 and driven pulleys 14 set on the spindles 5.

The oscillating mechanisms comprise cams 15 (FIGS. 1, 2) locked in place on the spindles 5, said cams being adapted to engage, with their shaped working face, loosely rotatable eccentric rollers 16 whose shafts 17 are held in position to brackets 18 of the rotor 6 (FIG. 1) Housings 19 of the spindles 5 are longitudinally traversable in the rotor 6, while springs 20 provided between the housings 19 of the spindles 5, and the rotor 6 are adapted to force the cams 15 against the rollers 16. The eccentric rollers 16 are adjustably traversable lengthwise the shafts 17 through the agency of supports 21 (FIG. 2) which are fixably traversable along the shafts 17.

The machine proposed herein operates as follows.

The workpieces 4 being machined (FIG. 1) are clamped in the spindles 5 and moved down into the air gap 3 of the electromagnetic system 2, whereupon a batch of the ferromagnetic abrasive powder is charged into the air gap 3 and the electromagnetic system 2 is energized. Then the motor 8 is switched on so as to pass the workpieces 4 through the air gap 3. Simultaneously the motor 11 is switched on as well to impart rotation to the spindles 5 carrying the cams 15.

When the oscillating mechanisms operate the rotating cams 15 ride with their shaped working faces over the respective eccentric rollers 16 that are in engagement with said cams, whereby oscillating motion of the spindles 5 occurs. The springs 20 constantly force the cams 15 against the eccentric rollers 16, whereby an unceasable contact of the cams 15 with the rollers 16 is attained. Depending upon the size of the workpieces 4 one must set a maximum oscillation amplitude by virtue of appropriately positioning the eccentric rollers 16 on their shafts 17.

It should be noticed that the oscillating mechanism provides for nonrepeatable and uniformly spaced contact marks of the grains of the ferromagnetic abrasive powder left on the surfaces of the workpieces 4 being machined. This is attained due to nonrepeated combinations of the mutual positions of the cam 15 and the eccentric roller 16 when they contact each other, whereby the amplitude and frequency of oscillations performed by the spindle 5 are continually changed.

We claim:

1. A machine for three-dimensional polishing of workpieces shaped as solids of revolution in a magnetic field using ferromagnetic abrasive powder, comprising: an electromagnetic system featuring and air gap; a ferromagnetic abrasive powder accommodated in said air gap of the electromagnetic system; spindles for the workpieces being machined to hold therein; a mechanism for said spindles to traverse in order to pass the workpieces clamped therein through said air gap of the electromagnetic system; mechanisms for said spindles to rotate round their own axes; a mechanism for imparting oscillating motion to each of said spindles comprising; a cam for each of said oscillating mechanisms, said cam being held in place on the spindle; a shaped working face on said cam; an eccentric roller for each of said oscillating mechanisms, said roller being in engagement with said cam working face; a shaft whereon said roller is loosely set, said shaft being square with the axis of rotation of said spindle carrying the cam.

2. A machine as claimed in claim 1, wherein each of said eccentric rollers is adjustably traversable lengthwise of said shaft in order to change its distance from the axis of rotation of said spindle carrying the said cam.

* * * * *